US008376645B2

(12) United States Patent
Whaley

(10) Patent No.: US 8,376,645 B2
(45) Date of Patent: Feb. 19, 2013

(54) BINDER METAL WITH ACCESSORY ATTACHMENT CAPABILITY

(75) Inventor: Paul Whaley, Herculaneum, MO (US)

(73) Assignee: U.S. Ring Binder, L.P., St. Louis, MO (US)

( * ) Notice: Subject to any disclaimer, the term of this patent is extended or adjusted under 35 U.S.C. 154(b) by 401 days.

(21) Appl. No.: 12/731,731

(22) Filed: Mar. 25, 2010

(65) Prior Publication Data

US 2010/0247226 A1 Sep. 30, 2010

Related U.S. Application Data

(60) Provisional application No. 61/164,227, filed on Mar. 27, 2009.

(51) Int. Cl.
*B42F 13/12* (2006.01)

(52) U.S. Cl. ..... 402/80 R

(58) Field of Classification Search ..... 402/70, 402/80 R, 60–69, 4, 79
See application file for complete search history.

(56) References Cited

U.S. PATENT DOCUMENTS

| | | | | |
|---|---|---|---|---|
| 2,821,197 | A * | 1/1958 | Bilbrey | 402/4 |
| 4,820,071 | A * | 4/1989 | Steinfield et al. | 402/4 |
| 4,909,652 | A | 3/1990 | Harrison | |
| 5,678,943 | A | 10/1997 | Parsons | |
| 5,725,251 | A | 3/1998 | Heggeland | |
| 6,550,812 | B1 * | 4/2003 | Castillo et al. | 281/37 |
| 7,419,324 | B2 | 9/2008 | Whaley | |

* cited by examiner

*Primary Examiner* — Dana Ross
*Assistant Examiner* — Matthew G Katcoff
(74) *Attorney, Agent, or Firm* — Polster, Lieder, Woodruff & Lucchesi, L.C.

(57) ABSTRACT

A binder ring metal (10) includes a shield (12) fitting over and substantially enclosing a mechanism by which at least one binder ring (14) of the metal is open and closed. The shield has a top surface (22) and an annular flange (24) forming a sidewall of the shield. At least one recess (32) is formed on the top surface of the shield. The recess is sized and shaped for an accessory to be attached to the top surface of the shield and to thereafter be portable with a ring binder to which the metal is attached. This facilitates ease of access to the accessory by a user of the ring binder. In addition, a trigger (62) installed at one end of the metal is formed using a molding process which allows a finger pad (64) of the trigger to be molded in place together with the body (66) portion of the trigger.

15 Claims, 5 Drawing Sheets

BINDER METAL WITH ACCESSORY ATTACHMENT CAPABILITY

CROSS-REFERENCE TO RELATED APPLICATIONS

U.S. provisional patent application 61/164,227 filed Mar. 27, 2009.

STATEMENT REGARDING FEDERALLY SPONSORED RESEARCH

Not Applicable.

BACKGROUND OF THE INVENTION

The present invention relates to a binder ring metal having a shield or cover to which various accessories can be attached, either alone, or in combination; and more particularly, to such a shield or cover which facilitates attachment of the accessory in a convenient position and thereafter holds the accessory in place until removed by the user.

Conventional binder ring metals include a shield or cover which comprises an elongate piece of metal or plastic whose length generally corresponds to the length of the metal or binder in which the metal is installed. Ring binders in which the metals are installed typically have pockets for holding and storing accessories such as pens and pencils, calculators, clocks or watches, etc. In co-assigned U.S. Pat. No. 7,419,324 there is described a binder ring metal having an insert removably attached to the shield. The insert includes various means by which different accessories are secured to it for carrying within a binder while providing ready access to the accessory whenever the accessory is required for use.

It will be appreciated by those skilled in the art that provision of the insert, even though it is of low cost, still adds cost to the ring metal. In addition, while the insert is of a lightweight material, it still adds weight to the ring metal. Further, when the insert is not in use, there is the possibility of it being lost or broken.

BRIEF SUMMARY OF THE INVENTION

The present invention is directed to an improved ring metal construction. Now, the shield or cover is constructed so various accessories can be attached directly to it without the need of an insert such as that described in the patent referenced above. The shield or cover comprises an elongate plate the length of which generally, but does not necessarily, correspond to the length of the ring metal. The shield is constructed so to allow a variety of accessories to be directly attached to it so the accessories are readily transported with the binder to which the ring metal is installed. The accessories are removable by a user, at their convenience, and can be re-attached to the shield when not in use.

A second feature of the present invention is a ring metal having at least one trigger or actuator mounted to one end of the ring metal. The trigger is a molded plastic trigger preferably formed using a two-step molding technique in which a finger or thumb pad for a user to press and move the actuator is molded in place at the same time the body of the actuator is molded.

It is also a feature of the invention that an annular flange portion of the ring metal shield or cover, which forms a sidewall of the shield, is shaped to form an end bracket for mounting the trigger to the shield. The bracket comprises parallel arms or ears extending from the end of the shield where the trigger is mounted. Adjacent the outer end of each arm a hole is formed for a mounting pin to be inserted through one of the openings, through a bore extending transversely of the trigger, and through the hole in the opposite arm. The resulting installation forms a pivot for the trigger so to rotate the trigger to open and close the ring binder in the conventional manner.

The present invention provides a relatively low cost, easy to use, ring metal and allows the user greater access to a variety of accessories that can be mounted on the shield or cover.

Other features will be in part apparent and in part pointed out hereinafter.

BRIEF DESCRIPTION OF THE SEVERAL VIEWS OF THE DRAWINGS

The objects of the invention are achieved as set forth in the illustrative embodiments shown in the drawings which form a part of the specification.

Corresponding reference characters indicate corresponding parts throughout the several views of the drawings.

DETAILED DESCRIPTION OF THE INVENTION

Figure 1:
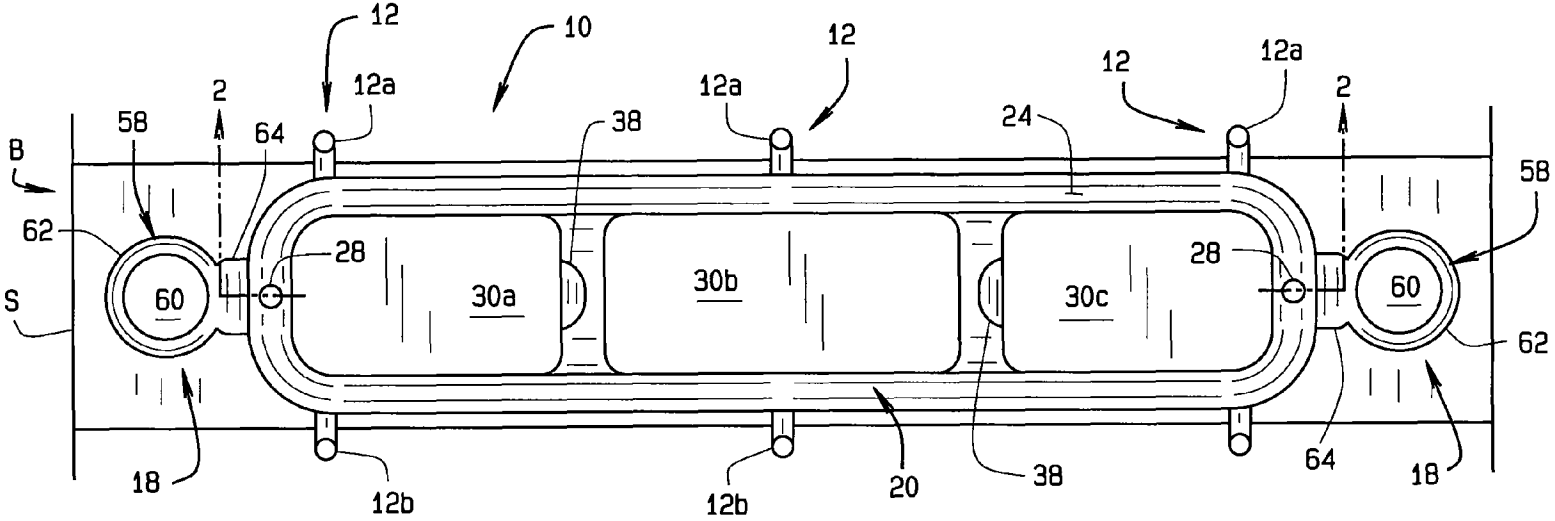
FIG. 1 is a plan view of a first embodiment shield for a ring metal of the present invention to which accessories can be attached.

The following detailed description illustrates the invention by way of example and not by way of limitation. This description clearly enables one skilled in the art to make and use the invention, and describes several embodiments, adaptations, variations, alternatives and uses of the invention, including what is presently believed to be the best mode of carrying out the invention. Additionally, it is to be understood that the invention is not limited in its application to the details of construction and the arrangement of components set forth in the following description or illustrated in the drawings. The invention is capable of other embodiments and of being practiced or carried out in various ways. Also, it will be understood that the phraseology and terminology used herein is for the purpose of description and should not be regarded as limiting.

Referring to the drawings, a ring metal of the present invention is indicated generally 10. As is known in the art, ring metal 10 is secured to the spine S of a binder B. Ring metal 10 includes a plurality of binder rings 12, each of which comprises ring segments 12*a* and 12*b*. In the drawings, three binder rings 12 are shown, one binder ring being located adjacent each end of the ring metal, and a third binder ring in the middle thereof. One end of each binder ring segment is attached to a hinge plate 14, 16 (see FIGS. 2 and 8). A trigger 18 is located at least one end of the ring metal; although, as shown in the drawings, a trigger can be located at each end of the metal.

Figure 2:
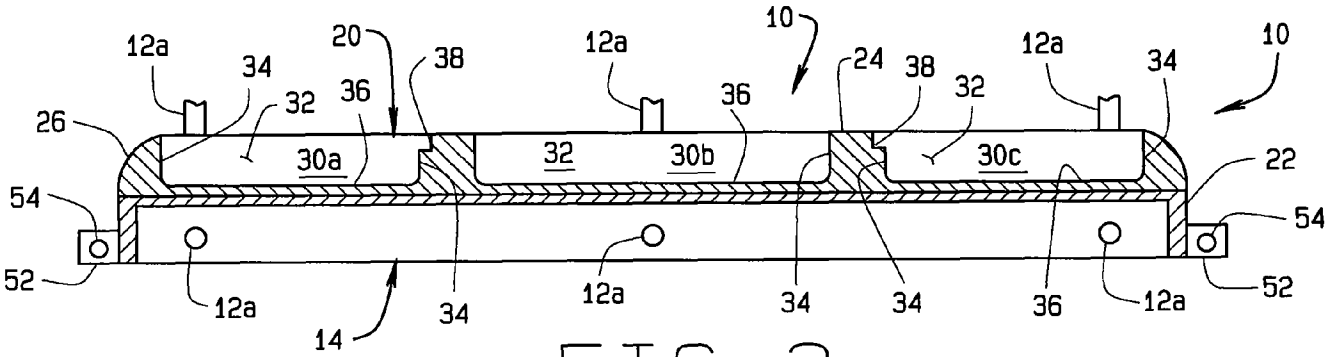
FIG. 2 is a sectional view of the shield taken along line 2-2 in FIG. 1.
Figure 8:
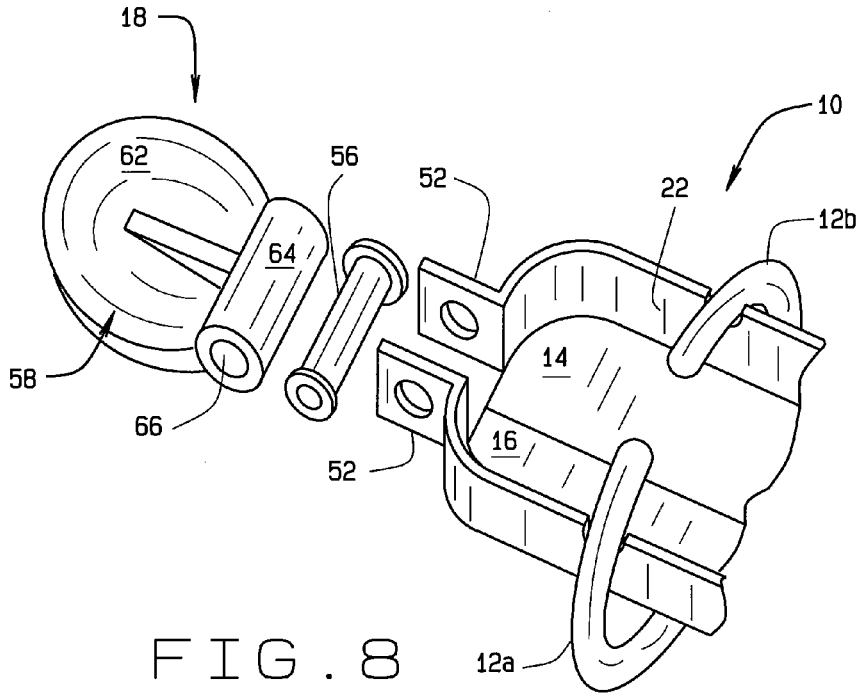
FIG. 8 is a perspective view of the trigger installation viewed from the underside of the ring metal.

Ring metal 10 next includes a shield or cover 20. As shown in FIGS. 2 and 8, the shield fits over the hinge plates 14,16. The respective ring segments 12*a*, 12*b* extend from beneath the shield, and up and around a sidewall 22 of the shield. The shield comprises a single stamped metal piece having an upper or top surface 24 extending substantially the length of the shield. The sidewall 22 of the shield comprises a flange extending about the circumference of the shield; the shield having a transitional section 26 extending between top surface 24 of the shield and its sidewall. An opening 28 is formed in the top surface of the shield, adjacent each end of the shield. A fastener such as a rivet (not shown) is inserted through each opening for attaching ring metal 10 to spine S of the binder and securing it in place.

Figure 3:
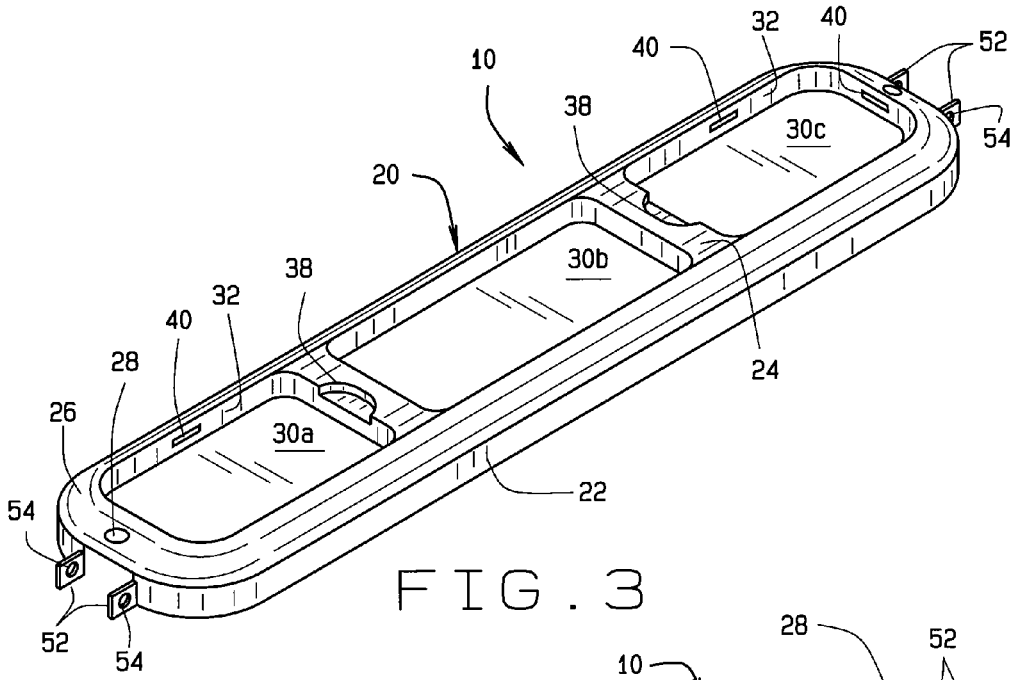
FIG. 3 is a perspective view of a second embodiment of the shield.
Figure 4:
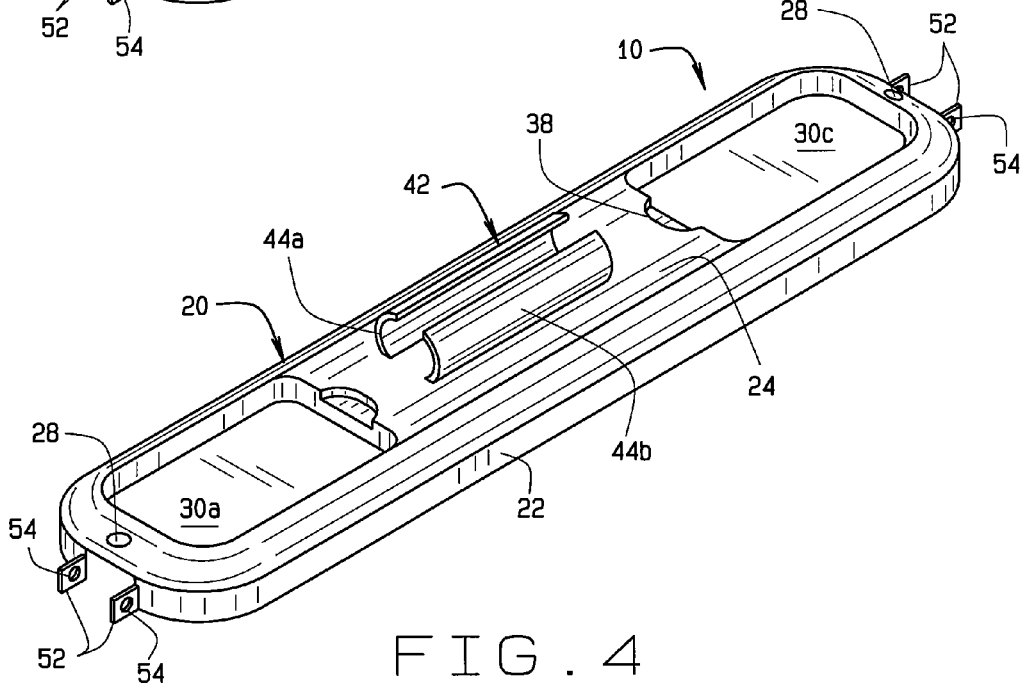
FIG. 4 is a perspective view of a third embodiment of the shield.
Figure 9:
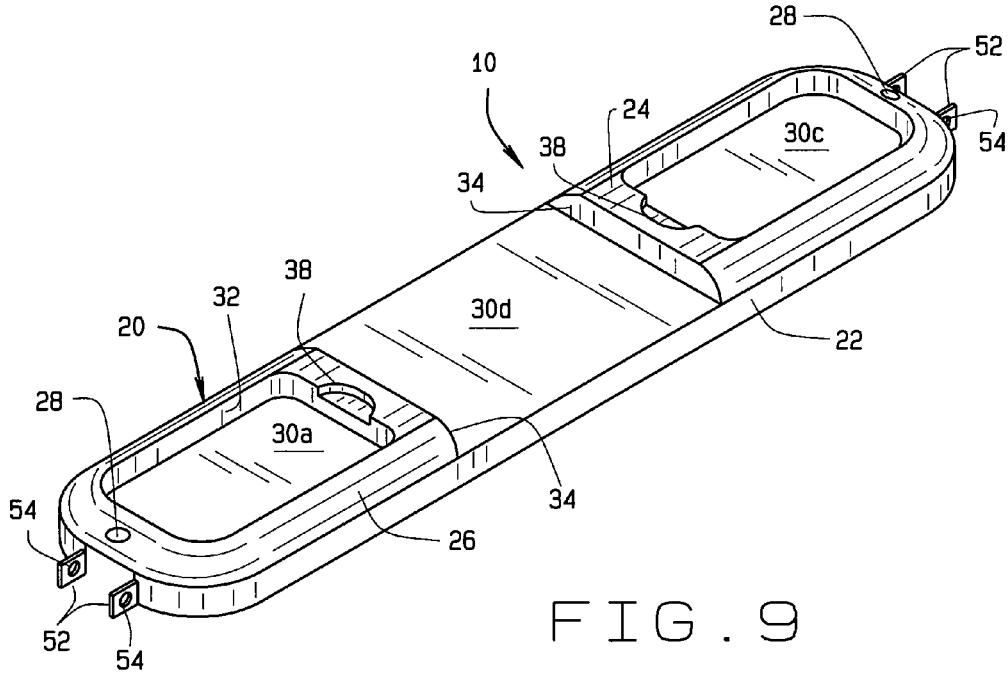
FIG. 9 is a perspective view of a fourth embodiment of the shield.

In accordance with the present invention, at least one, and preferably a plurality of recesses 30 are formed in top surface 24 of the shield. As shown in FIGS. 1, 2, and 4, three such recesses 30*a*, 30*b*, and 30*c* are formed in the top surface of shield 20 by stamping or the like. Each recess is generally rectangular in shape; although the recess can be other geometric shapes (round, square, oval, pentagonal, hexagonal, octagonal, etc.) without departing from the scope of the invention. Referring to FIG. 9, a recess 30*d* differs from the other recesses in that it extends through transitional section 26 and sidewall 22 of the shield. Referring to FIG. 2, each recess 30*a*-30*c* has sidewalls 32 and endwalls 34, and a base or floor 36 which extends the length of the recess. Recess 30*d*, however, does not have sidewalls, only endwalls 34 and a base 36. The recesses 30*a* and 30*c* each also have a recessed extension or ledge 38. As shown in FIG. 2, this extension is not as deep as the remainder of the recess and extends from the main portion of the recess 30*a* or 30*c*. The ledge 38 allows a user to extract an accessory fitted into one of these recesses using their finger or a tool. Further, as shown in FIG. 3, slots 40 are formed in the sidewalls and endwalls of the recesses. The slots engage tabs extending from the sides and/or ends of an accessory so to install the accessory in a recess.

Figure 11:
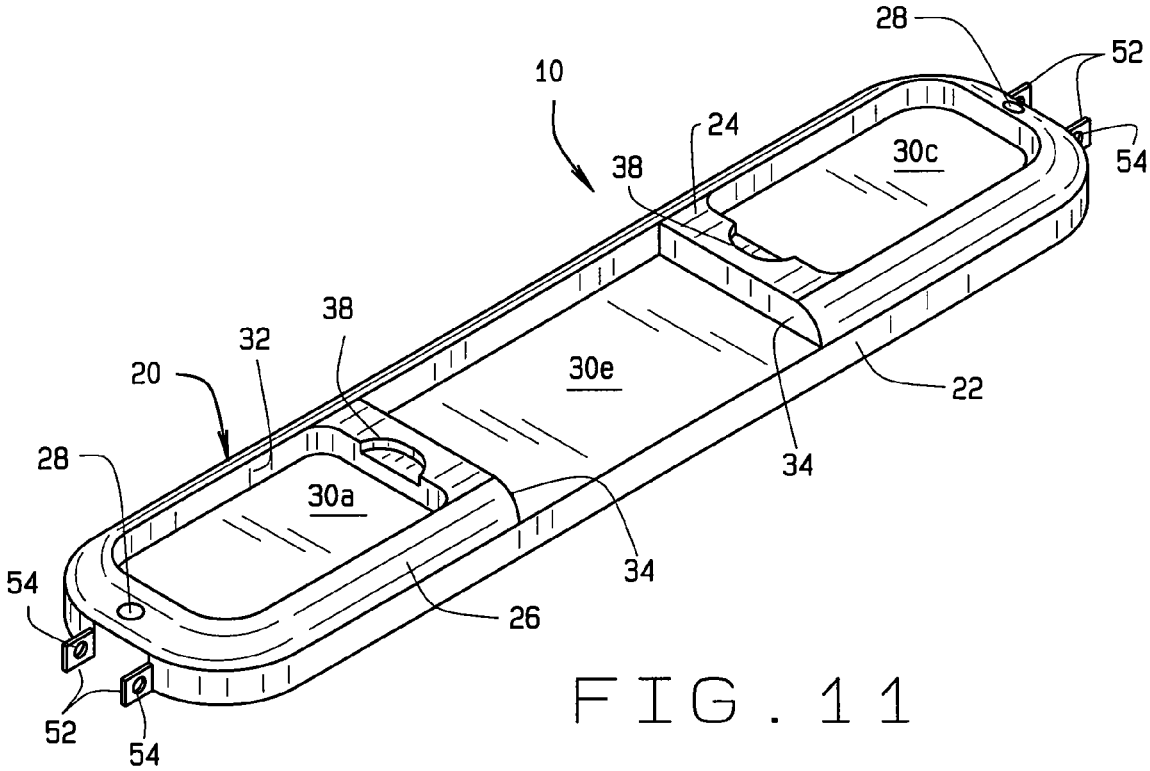

Referring to FIG. 11, a recess 30*e* differs from the other described recesses in that it extends through transitional section 26 and sidewall 22 on one side of the shield, so that there is a sidewall 32 only along one side of the recess.

As shown in the FIG. 4, besides the recesses 30, the present invention further includes a bracket 42 formed on top surface 24 of shield 20. In FIG. 4, bracket 42 includes spaced apart, complementary shaped bracket sections 44*a*, 44*b*. These sections are each curved sections and a spaced apart a distance sufficient for a pen or pencil, for example, to be fitted into the bracket.

Figure 10:
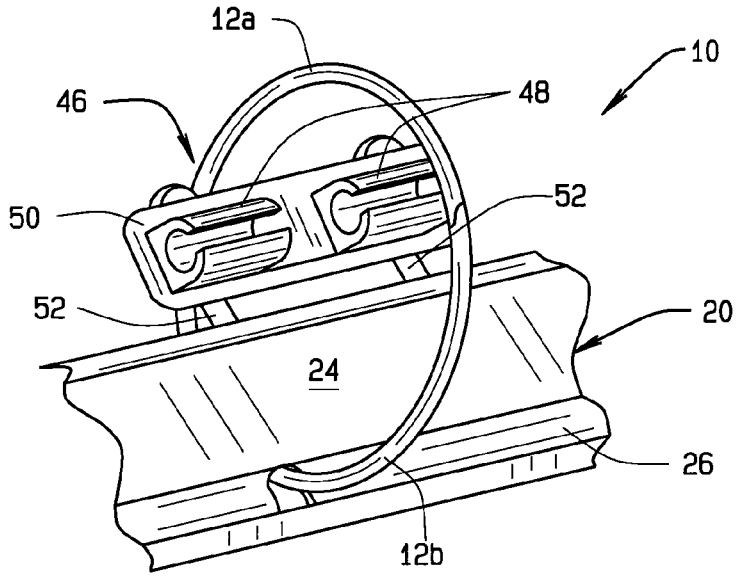
FIG. 10 is a perspective view of a fifth embodiment of the invention in which an attachment for an accessory is fitted to the shield for carrying the accessory; and, FIG. 11 is a perspective view of a sixth embodiment of the shield.

Referring to FIG. 10, the present invention further includes an attachment 46 having a bracket 48 similar to bracket 42 formed on a top surface 50 of the attachment. Bracket 48 is shown as a two piece bracket; although it could be a one-piece bracket as is bracket 42. Attachment 46 includes a pair of struts 50 which extend between top surface 50 of the attachment and shield 20, so to attach the attachment to the shield. Attachment 46 is sized to fit between shield 20 and under a binder ring 12. As with attachment 42, attachment 46 is, for example, a pen or a pencil.

Figure 5:
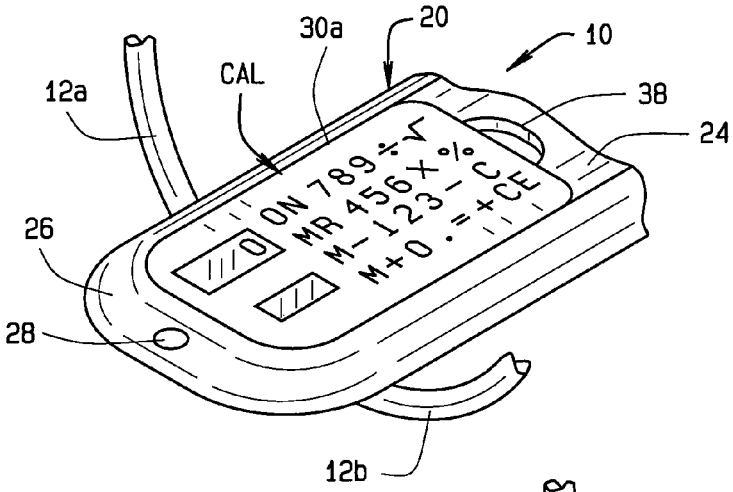
FIG. 5 illustrates the attachment of a first accessory to the shield.
Figure 6:
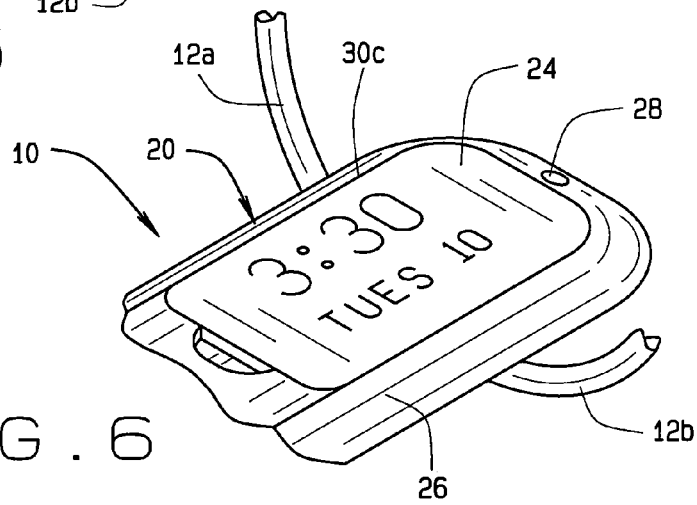
FIG. 6 illustrates the attachment of a second accessory to the shield.
Figure 7:
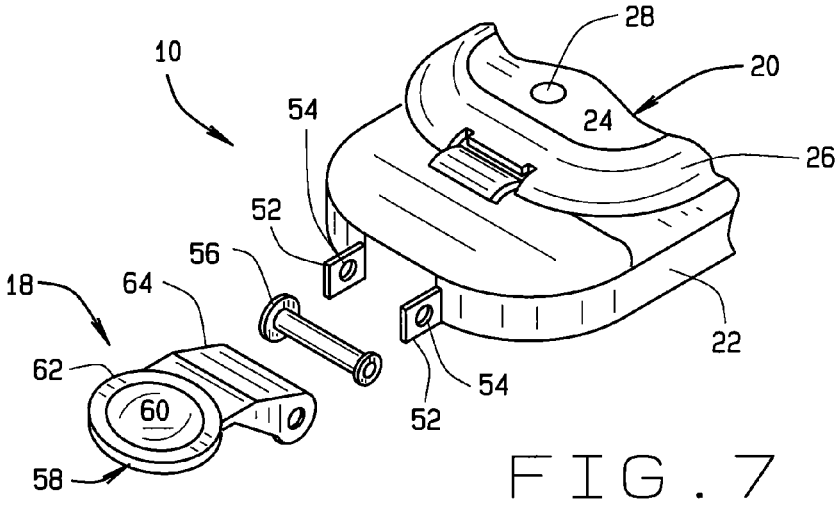
FIG. 7 is a perspective view of an end of the shield illustrating attachment of a trigger used to open and close the ring metal to the shield.

Those skilled in the art will appreciate that the location of the various described recesses and attachment can be other than as shown in the drawings without departing from the scope of the invention. It will also be appreciated that a variety of accessories can now be carried on shield 20. Thus, as shown in FIG. 5, a calculator CAL can be removably installed in, for example, recess 30*a*; while, as shown in FIG. 6, a clock CLO can be removably installed in recess 30*c*. As noted, a pen or pencil can be removably installed in attachment 42 or 46.

In addition to the above described ways of attaching or securing accessories to the ring metal, other means of attachment or securing are also possible without departing from the scope of the invention. For example, the various recesses can be sized and shaped so an accessory can be snap-fitted in place and held in place by the friction between the accessory and sidewalls and/or endwalls of the recess. Alternately, hooks, snaps, or clamps are installed adjacent a recess and connect to, or overlay, an accessory once it is installed in place to hold it in place.

It will also be understood by those skilled in the art that besides forming recesses in a shield or cover, an attachment or holder for an accessory can be attached to the shield by riveting, welding, or gluing, for example, the attachment to the shield.

Next, at one end, or each end of ring metal 10, an actuator or lever 18 is installed. For this purpose, a pair of flanges 52 are formed in sidewall 22 of the shield, at the end of the ring metal where an actuator is located. Each flange 52 extends outwardly from the end of the shield parallel to, and equidistantly spaced from the centerline of the shied. Each flange has a hole 54 for insertion of a pin 56 therethrough. While the drawings illustrate an actuator 18 installed at each end of the ring metal; in practice, the ring metal works as well with only one actuator.

Actuator 18 is a mold-in-mold part having a main body portion 58 and a pad 60 encompassed or surrounded by the body portion of the actuator. Man body portion 58 has a saucer or bowl shaped upper section 62 in which pad 60 is formed during the molding process. It will be understood by those skilled in the art that pad 60 of actuator 18 may be of one material and color with main body portion 58 being of another material and a different color. Main body portion 58 has a lower section 64 in which is formed a transverse bore 66 sized for insertion of pin 56 through the bore. This then allows actuator 18 to be attached to the ring metal using the pin and with the pin, once the actuator is installed, acting as a pivot about which actuator 18 rotates to open and close the binder rings. Operation of one or both actuators 18 to open and close the binder rings is conventional and is not described.

In view of the above, it will be seen that the several objects and advantages of the present disclosure have been achieved and other advantageous results have been obtained.

The invention claimed is:

1. In a binder ring metal having at least one binder ring, the improvement comprising:

a shield fitting over and substantially enclosing a mechanism by which the said at least one binder ring is opened and closed, the shield having a top surface and an annular flange forming a sidewall of the shield, the shield being at least partially encircled by the binder ring; and, at least one recess formed on the top surface of the shield by which an accessory is attached to the shield and is portable therewith for ease of access by a user of a ring binder on which the binder ring metal is installed, the recess having endwalls and a base, but no sidewalls.

2. The improvement of claim 1 further including a plurality of recesses formed in the top surface of the shield, each recess being sized and shaped to receive an accessory and hold it in place until removed.

3. The improvement of claim 2 in which the recesses are spaced recesses.

4. The improvement of claim 2 in which each recess is generally rectangular in shape.

5. The improvement of claim 2 in which at least one of the other recesses has sidewalls together with endwalls and a base thereby for supporting an accessory when placed in the recess.

6. The improvement of claim 5 in which a slot is formed in at least one of the sidewalls or endwalls to receive a tab extending from the accessory, for fitting and holding the accessory in place.

7. The improvement of claim 2 in which one of the recesses has a sidewall extending only along one side of the recess.

8. The improvement of claim 5 in which the recess is sized and shaped so as to allow an accessory to be snap-fitted into place in the recess and subsequently held in place in the recess by a friction fit.

9. The improvement of claim 5 further including means engaging the accessory once installed in a recess to hold the accessory in the recess.

10. The improvement of claim 9 further including an attachment attachable to the shield to hold an accessory in place on the shield.

11. The improvement of claim 2 in which the attachment is attached to the shield by a rivet.

12. The improvement of claim 2 in which the attachment is attached to the shield by welding.

13. The improvement of claim 2 in which the attachment is attached to the shield by gluing.

14. The improvement of claim 1 further including at least one actuator for opening and closing the binder ring, the actuator being a molded part having two pieces molded together when the actuator is formed.

15. The improvement of claim 14 in which the actuator is formed using a mold-in-mold process.

* * * * *